US010102944B2

(12) United States Patent
Kohori et al.

(10) Patent No.: US 10,102,944 B2
(45) Date of Patent: Oct. 16, 2018

(54) COATED ELECTRIC WIRE AND MULTI-CORE CABLE FOR VEHICLES

(71) Applicant: SUMITOMO ELECTRIC INDUSTRIES, LTD., Osaka-shi, Osaka (JP)

(72) Inventors: Takaya Kohori, Kanuma (JP); Hiroyuki Okawa, Kanuma (JP)

(73) Assignee: SUMITOMO ELECTRIC INDUSTRIES, LTD., Osaka-shi, Osaka (KP)

( * ) Notice: Subject to any disclaimer, the term of this patent is extended or adjusted under 35 U.S.C. 154(b) by 0 days.

(21) Appl. No.: 15/679,264

(22) Filed: Aug. 17, 2017

(65) Prior Publication Data

US 2018/0061525 A1 Mar. 1, 2018

(30) Foreign Application Priority Data

Aug. 24, 2016 (JP) ..... 2016-163844

(51) Int. Cl.

| | |
|---|---|
| ***H01B 7/18*** | (2006.01) |
| ***H01B 7/295*** | (2006.01) |
| ***H01B 9/00*** | (2006.01) |
| ***H01B 7/28*** | (2006.01) |

(52) U.S. Cl.

CPC ..... *H01B 7/1875* (2013.01); *H01B 7/28* (2013.01); *H01B 7/295* (2013.01); *H01B 9/003* (2013.01)

(58) Field of Classification Search

CPC ..... H01B 7/1875; H01B 7/28; H01B 7/295

See application file for complete search history.

(56) References Cited

U.S. PATENT DOCUMENTS

| | | | | |
|---|---|---|---|---|
| 9,153,361 | B2 * | 10/2015 | Watanabe | H01B 11/18 |
| 2013/0266280 | A1 * | 10/2013 | Sakabe | H01B 11/22 385/101 |
| 2014/0326480 | A1 * | 11/2014 | Hashimoto | H01B 7/295 174/113 R |
| 2016/0163417 | A1 * | 6/2016 | Iwasaki | H01B 3/441 174/120 SR |

FOREIGN PATENT DOCUMENTS

JP 2014-220043 A 11/2014

* cited by examiner

*Primary Examiner* — Timothy Thompson
*Assistant Examiner* — Amol Patel
(74) *Attorney, Agent, or Firm* — Drinker Biddle & Reath LLP

(57) ABSTRACT

A multi-core cable for vehicles comprises two power lines, two signal lines, two electric wires, and a jacket. The two power lines are the same in size and material, each comprise an insulation layer composed of an inner layer and an outer layer, and are excellent in abrasion resistance and bending resistance. The two signal lines are the same in size and material and the two lines are twisted as a set to constitute a twisted pair of the signal lines. The two electric wires are the same in size and material and the two wires are twisted as a set to constitute a twisted pair of the electric wires. The two power lines, the twisted pair of the signal lines, and the twisted pair of the electric wires are integrally twisted.

7 Claims, 3 Drawing Sheets

COATED ELECTRIC WIRE AND MULTI-CORE CABLE FOR VEHICLES

CROSS-REFERENCE TO RELATED APPLICATION

The present application claims the benefit of priority of Japanese Patent Application No. 2016-163844, filed on Aug. 24, 2016, which is incorporated herein by reference.

BACKGROUND

Technical Field

The present invention relates to a coated electric wire and a multi-core cable for vehicles.

Related Art

JP-A-2014-220043 discloses an electric insulated cable including an electric wire that transmits an electric signal to a motor of an electric parking brake (EPB; Electric Parking Brake) (EPB wire) and an electric wire that transmits an electric signal controlling the action of ABS (Anti-locking Brake System) (ABS wire).

The EPB wire is branched from the other wire with removing the jacket from the middle of the electric insulation cable to become in a state that the EPB wire is exposed and is connected to the motor of EPB in this state. Since the EPB wire is used in a state that at least a part thereof is exposed, high abrasion resistance is required for the EPB wire.

In addition, parts at a wheel side, such as the motor of EPB, are displaced together with a tire against the vehicle body. Therefore, high bending resistance is required for a multi-core cable connecting the vehicle body and the parts at the wheel side.

SUMMARY

An object of the present invention is to provide a coated electric wire comprising an insulation layer composed of an inner layer and an outer layer and having excellent abrasion resistance and bending resistance and a multi-core cable including the same.

In order to achieve the above object, the coated electric wire for vehicles of the present invention is an electric wire comprising a conductor and a resin-made insulation layer that covers the conductor:

cross-sectional area of the conductor being 1.5 $mm^2$ or more and 3.0 $mm^2$ or less, the insulation layer covering the conductor in a thickness of 0.3 mm or more and 0.5 mm or less, and the insulation layer having an inner layer and an outer layer that is provided on the outer periphery of the inner layer, wherein one of the inner layer and the outer layer contains a copolymer of ethylene and an α-olefin having a carbonyl group and the other of the inner layer and the outer layer is composed of a polyolefin or a fluororesin.

Moreover, in order to achieve the above object, the multi-core cable for vehicles of the present invention comprises:

two wires of the coated electric wire of the present invention and a jacket that covers the two coated electric wires.

According to the present invention, there are provided a coated electric wire and a multi-core cable for vehicles, which are excellent in abrasion resistance and bending resistance.

DETAILED DESCRIPTION

Summary of Embodiments of the Invention

Figure 1:
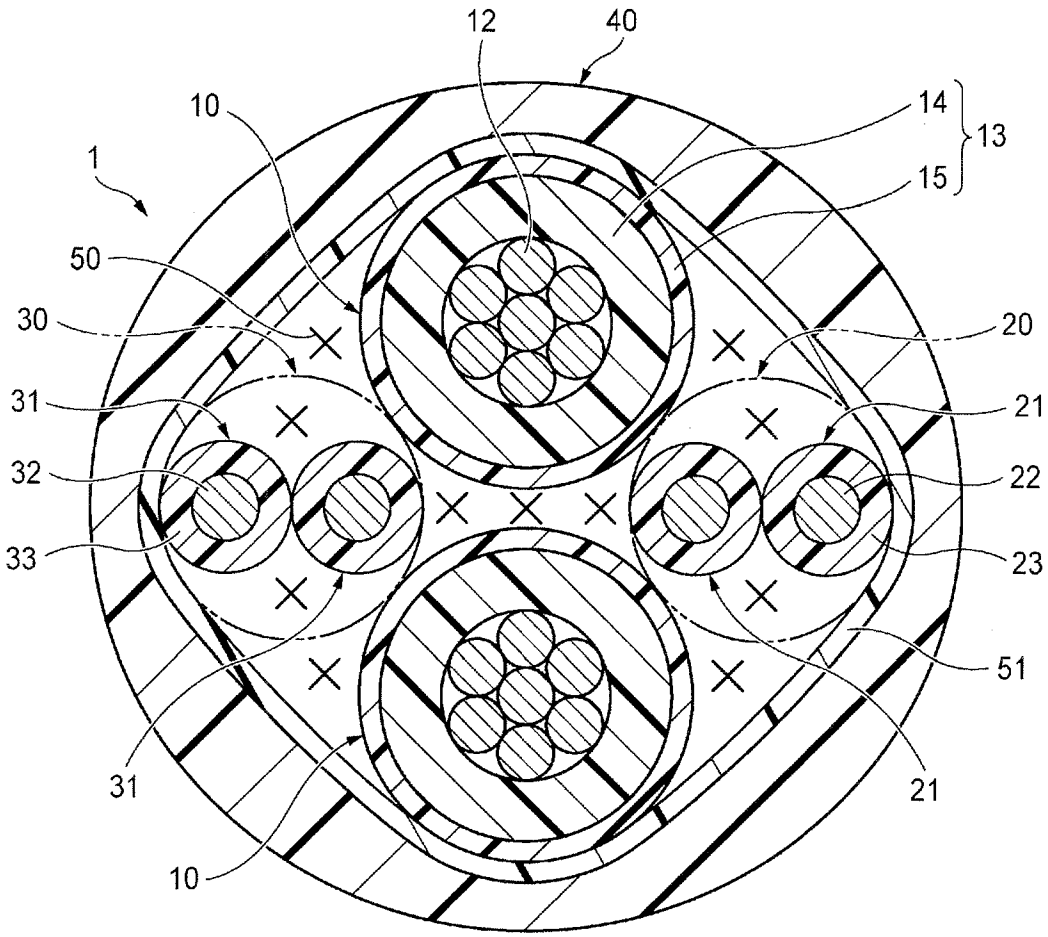
FIG. 1 is a cross-sectional view showing the coated electric wire and multi-core cable for vehicles according to the first embodiment of the present invention.

First, summary of the embodiments of the present invention will be described.

(1) A coated electric wire comprises a conductor and a resin-made insulation layer that covers the conductor. Cross-sectional area of the conductor is 1.5 $mm^2$ or more and 3.0 $mm^2$ or less. The insulation layer covers the conductor in a thickness of 0.3 mm or more and 0.5 mm or less. The insulation layer has an inner layer and an outer layer that is provided on the outer periphery of the inner layer. One of the inner layer and the outer layer contains a copolymer of ethylene and an α-olefin having a carbonyl group and the other of the inner layer and the outer layer is composed of a polyolefin or a fluororesin.

Since a copolymer of ethylene and an α-olefin having a carbonyl group is easily deformed, the copolymer deforms together with the conductor at the time when a conductor is bent. Therefore, a large stress is not generated on the conductor, and the copolymer is excellent in bending resistance. However, since the copolymer is soft, it is insufficient in view of abrasion resistance.

On the other hand, a polyolefin and a fluororesin are hard and are excellent in abrasion resistance.

The insulation layer of the coated electric wire for vehicles having the above configuration has each of a layer excellent in bending resistance and a layer excellent in abrasion resistance. Therefore, the coated electric wire of (1) is excellent in bending resistance and abrasion resistance.

(2) The coated electric wire according to (1), wherein the inner layer may contain the copolymer of ethylene and an α-olefin having a carbonyl group as a main component.

By providing the layer composed of a polyolefin or a fluororesin that is hard and has abrasion resistance on an outer side, the abrasion of the electric wire can be reduced. In addition, by providing the copolymer of ethylene having a buffering action for bending stress and an α-olefin having a carbonyl group on an inner side, an effect of further buffering the stress generated on the conductor is obtained.

(3) The coated electric wire according to (1), wherein the inner layer is composed of a polyolefin or a fluororesin.

The polyolefin and fluororesin that constitute the inner layer are hard and excellent in abrasion resistance. In addition, the fluororesin has a good sliding property against a metal and thus a force of pulling the conductor or a force pushing it by the inner layer is less generated at the time when the conductor is bent.

The copolymer of ethylene and an α-olefin having a carbonyl group, which constitutes the outer layer, is easily deformed. Therefore, the outer layer is deformed together with the conductor at the time when the conductor is bent and thus does not generate a high stress on the conductor, so that the copolymer is excellent in bending resistance.

(4) The coated electric wire according to any one of (1) to (3), wherein, of the inner layer and the outer layer, the layer containing the copolymer of ethylene and an α-olefin having a carbonyl group as a main component is thicker than the layer composed of a polyolefin or a fluororesin and the thickness of the layer composed of the polyolefin or the fluororesin is 0.05 mm or more.

Since the layer excellent in bending resistance is thicker than the layer excellent in abrasion resistance, the coated electric wire having the above configuration has increased bending resistance.

(5) The coated electric wire according to any one of (1) to (4), wherein the α-olefin having a carbonyl group contains at least one of (meth)acrylic acid alkyl esters, (meth)acrylic acid aryl esters, vinyl esters, unsaturated acids, vinyl ketones, and (meth)acrylic acid amides.

(6) A multi-core cable comprising two wires of the coated electric wire according to any one of (1) to (5) and a jacket that covers the two coated electric wires.

In the multi-core cable having the above configuration, a wiring operation is easy as compared with the case where the two coated electric wires are separately wired.

(7) The multi-core cable according to (6), which has a plurality of second electric wires each having a second conductor thinner than the conductor and a second insulation layer that covers the second conductor and wherein the two second electric wires are twisted as a set to constitute a twisted pair of the second electric wires.

In the multi-core cable having the above configuration, a wiring operation is easy as compared with the case where the two coated electric wires and the twisted pair of the second electric wires are separately wired.

(8) The multi-core cable according to (7), wherein the two coated electric wires and the twisted pair of the second electric wires are stranded and the jacket covers the stranded two coated electric wires and the twisted pair of the second electric wires.

In the multi-core cable having the above configuration, the two coated electric wires and the twisted pair of the second electric wires are stranded together and the stranded state is covered with a jacket, so that the outer shape of the multi-core cable is stabilized, in the length direction.

(9) The multi-core cable according to (8), wherein the two coated electric wires are disposed in a point symmetry in a cross section.

In the multi-core cable having the above configuration, thick coated electric wires are disposed with good balance in a cross section and the cable has good symmetry, the multi-core cable has less twisting tendency.

(10) The multi-core cable according to (6) or (7), wherein the ratio of a major axis length to a minor axis length (major axis length/minor axis length) is 1.8 or more in a cross section.

The multi-core cable having the above configuration can be suitably wired in a flat space. Moreover, the cable is easily bent in a minor axis direction (thickness direction) and is easily wired. Furthemiore, the multi-core cable is easily attached and fixed to a planar object such as a wall because a contact area of the cable is large.

DETAILS OF EMBODIMENTS OF THE INVENTION

The following will explain an example of the embodiment of the multi-core cable according to the present invention with reference to Drawings.

First Embodiment

A multi-core cable 1 is, for example, used for connecting ECU (Electric Control Unit) mounted on a vehicle and an electric parking brake (EPB), a wheel speed sensor, or the like provided around a wheel. The wheel is rotatably supported around an axle onto the vehicle body. Moreover, the wheel is supported via a suspension device or a steering device in some cases. That is, the wheel is displaceably supported on the vehicle body. The multi-core cable 1 of the present embodiment is suitably used for connecting ECU fixed to the vehicle body and a part to be attached to the wheel displaceably supported on the vehicle body.

For the multi-core cable 1, it is required to be wired in a small space in the tire house in which the wheel is set. In order not to inhibit the displacement of the wheel, easy bending, high durability against repeated bending to be repeatedly functioned, and the like are demanded.

FIG. 1 is a cross-sectional view showing the multi-core cable 1 according to the first embodiment of the present invention. FIG. 1 shows a cross section perpendicular to a longitudinal direction of the multi-core cable 1. As shown in FIG. 1, the multi-core cable 1 has two power lines 10, two signal lines 21, two electric wires 31, and a jacket 40. The outer diameter of the multi-core cable 1 of the present embodiment can be 7 mm or more and 18 mm or less, preferably 7.5 mm or more and 13 mm or less. The power line 10 is an example of the coated electric wire of the present invention. The signal line 21 is an example of the second electric wire of the present invention.

(Power Line)

The two power lines 10 each contain a first conductor 12 and a first insulation layer 13 that covers the first conductor 12. The two power lines 10 are the same in size and material.

The two power lines 10 can be used for connecting EPB and ECU. EPB has a motor that drives a brake caliper. For example, one of the power lines 10 can be used as a power-feeding wire that feeds power to the motor and another power line 10 can be used as a ground wire of the motor.

The first conductor 12 is configured by twisting a plurality of conductors. The conductor is a wire composed of copper or a copper alloy. The conductor can be composed of a material having predetermined conductivity and flexibility, such as a tin-plated annealed copper wire or an annealed copper wire besides copper or a copper alloy. The cross-sectional area of the first conductor can be 1.5 $mm^2$ or more and 3 $mm^2$ or less.

The first insulation layer is formed of an inner layer 14 containing a copolymer of ethylene and an α-olefin having a carbonyl group and an outer layer 15 composed of a polyolefin or a fluororesin. The layer containing the copolymer of ethylene and an α-olefin having a carbonyl group may contain another substance that improves flexibility and/or impact resistance. For example, the layer may contain a copolymer of an unsaturated hydrocarbon having 4 or more carbon atoms and ethylene (e.g., an ethylene-butene copolymer). For improving flame retardance, a metal hydroxide or a metal oxide or the other flame retardant may be added. The outer diameter of the first insulation layer 13 can be 2 mm or more and 4 mm or less.

The content of the α-olefin having a carbonyl group in the copolymer of ethylene and an α-olefin having a carbonyl group is preferably 5% by mass or more and 46% by mass or less, more preferably 10% by mass or more and 30% by mass or less. When the content is less than 5% by mass, there is a concern that an effect of improving the bending resistance at low temperature becomes insufficient. Moreover, when the content is more than 46% by mass, the abrasion resistance may be lowered.

The α-olefin having a carbonyl group preferably includes, for example, at least one of (meth)acrylic acid alkyl esters such as methyl (meth)acrylate and ethyl (meth)acrylate, (meth)acrylic acid aryl esters such as phenyl (meth)acrylate, vinyl esters such as vinyl acetate and vinyl propionate, unsaturated acids such as (meth)acrylic acid, crotonic acid, maleic acid, and itaconic acid, vinyl ketones such as methyl vinyl ketone and phenyl vinyl ketone, and (meth)acrylic acid amides. Therefore, the copolymer of ethylene and an α-olefin having a carbonyl group to be contained in the inner layer 14 may be a mixture of copolymers in which the α-olefins each having a carbonyl group are different from each other.

Moreover, it is preferred that the inner layer 14 is thicker than the outer layer 15 and the thickness of the outer layer is 0.05 mm or more.

(Signal Line)

The two signal lines 21 each contain a second conductor 22 thinner than the first conductor 12 and a second insulation layer 23 that covers the second conductor 22. The two signal lines 21 to be twisted are the same in size and material as each other. Two signal lines 21 are twisted as a set to constitute a twisted pair 20 of the signal line 21. The twisting pitch of the twisted pair 20 of the signal line 21 can be 10 times or more and 15 times or less the twisting diameter of the twisted pair 20 of the signal line 21 (outer diameter of the twisted pair 20 of the signal line 21). The twisted pair 20 of the signal line 21 is an example of the twisted pair of the second electric wires of the present invention.

The outer diameter of the twisted pair 20 of the signal line 21 can be about the same as the outer diameter of the power line 10.

The signal line 21 can be used for transmitting a signal from a sensor or can be used for transmitting a control signal from ECU. The two signal lines 21 can be, for example, used for wiring ABS (Anti-lock Brake System). The two signal lines 21 can be, for example, each used as a wire for connecting a differential wheel speed sensor and ECU of a vehicle.

The second conductor 22 may be composed of solid conductor or may be configured by stranding a plurality of conductors as in the case of the power line 10. The second conductor 22 may be composed of the same material as the conductor constituting the first conductor or a different material may be used. The cross-sectional area of the second conductor 22 can be 0.13 $mm^2$ or more and 0.5 $mm^2$ or less.

The second insulation layer 23 can be, for example, formed of a crosslinked polyethylene to which flame retardance is imparted by blending a flame retardant. The material constituting the second insulation layer 23 is not limited to a flame retardant polyethylene-based resin and may be formed of the other material such as a crosslinked fluororesin. The outer diameter of the second insulation layer 23 can be 1.0 mm or more and 2.2 mm or less.

(Electric Wire)

The two electric wires 31 each contain a third conductor 32 thinner than the first conductor 12 and a third insulation layer 33 that covers the third conductor 32. The two electric wires 31 are twisted as a set to constitute a twisted pair 30 of the electric wires 31. The two electric wires 31 to be twisted are the same in size and material. The electric wire 31 may be the same in size and material as the signal line 21. The twisted pair 30 of the electric wires 31 is preferably twisted in the same direction as that in the pair stranded signal line. The twisted pair 30 of the electric wires 31 is preferably equal in twisting pitch to the twisted pair 20 of the signal line 21. In the case where the twisting direction is different between the twisted pair 30 of the electric wires 31 and the twisted pair 20 of the signal line 21, the twisting pitch of the shorter one becomes long so that it becomes the same as the longer twisting pitch, and thus the bending resistance decreases.

The outer diameter of the twisted pair 30 of the electric wires 31 can be about the same as the outer diameter of the twisted pair 20 of the signal line 21. The outer diameter of the twisted pair 30 of the electric wires 31 can be about the same as the outer diameter of the power line 10.

The electric wires 31 can be used for transmitting a signal from a sensor, can be used for transmitting a control signal from ECU, or can be used as a power-feeding wire that feeds power to an electronic device.

The third conductor 32 may be composed of solid conductor or may be configured by stranding a plurality of conductors as in the case of the power line 10. The third conductor 32 may be composed of the same material as that of the conductor constituting the first conductor 12 or the second conductor 22, or a different material may be used. The cross-sectional area of the third conductor 32 can be 0.13 $mm^2$ or more and 0.5 $mm^2$ or less.

For the third insulation layer, the same material as that of the second insulation layer 23 can be used or a different material may be used. The outer diameter of the third insulation layer 33 can be 1.0 mm or more and 2.2 mm or less.

(Jacket)

The jacket 40 covers all wires including the two power lines 10, the two signal lines 21, and the two electric wires 31. The two power lines 10, one twisted pair 20 of the signal line 21, and one twisted pair 30 of the electric wires 31 are integrally stranded. The jacket 40 covers the two power lines 10, one twisted pair 20 of the signal line 21, and one twisted pair 30 of the electric wires 31 in an integrally twisted state.

The jacket 40 can be, for example, formed of a polyolefin-based resin such as polyethylene or an ethylene-vinyl acetate copolymer (EVA), a polyurethane elastomer, a polyester elastomer, or a composition formed by mixing at least two kinds thereof. In addition, the jacket can be, for example, composed of a crosslinked/non-crosslinked themioplastic polyurethane (TPU) excellent in abrasion resistance. Owing to excellent heat resistance, the jacket 40 is preferably composed of a crosslinked thermoplastic polyurethane.

The outer diameter of the jacket 40 can be 7.5 mm or more and 11 mm or less.

(Twisting Direction, Twisting Pitch)

The two power lines 10, one twisted pair 20 of the signal line 21, and one twisted pair 30 of the electric wires 31 are integrally twisted. The twisting diameter of the whole of these integrally twisted wires can be 55 mm or more and 9 mm or less.

The twisting pitch of the whole of the two power lines 10, one twisted pair 20 of the signal line 21, and one twisted pair 30 of the electric wires 31 can be 12 time and more and 24 time or less the twisting diameter of the whole of the two power lines 10, one twisted pair 20 of the signal line 21, and one twisted pair 30 of the electric wires 31. When the twisting pitch is larger than 24 times the twisting diameter, twisting becomes too loose and the bending resistance is lowered. When the twisting pitch is short, the bending resistance is not adversely affected but the productivity of the cable is poor.

The ratio of the twisting pitch of the whole of the two power lines 10, one twisted pair 20 of the signal line 21, and one twisted pair 30 of the electric wires 31 to the twisting diameter of the whole is preferably larger than the ratio of the twisting pitch of the twisted pair 20 of the signal line 21 to the twisting diameter of the twisted pair 20 of the signal line 21. The whole twisting direction is preferably a direction reverse to the twisting direction of the twisted pair 20 of the signal line 21 and the twisted pair 30 of the electric wires 31.

(Filler)

The multi-core cable 1 may have a filler 50. The filler 50 is provided inside the jacket 40. The filler 50 can be composed of a fiber such as a spun rayon yarn or a Nylon yarn. The filler 50 may be composed of a tension fiber.

The filler 50 is provided in a gap formed by two power lines 10. The filler 50 may be provided between the power line 10 and the signal line 21, between the power line 10 and the electric wire 31, between the two signal lines 21, and between the two electric wires 31, in addition to the gap between the two power lines 10.

(Wrapping)

The multi-core cable 1 may have a wrapping 51. The wrapping 51 covers the two power lines 10, one twisted pair 20 of the signal line 21, and one twisted pair 30 of the electric wires 31. The wrapping 51 stably maintains the shape of twisted these wires. The wrapping 51 is provided inside the jacket 40.

As the wrapping 51, for example, a paper tape or a nonwoven fabric or a tape made of a resin such as a polyester can be used. Moreover, the wrapping 51 may be spirally wound or longitudinally wrapped on the two power lines 10, one twisted pair 20 of the signal line 21, and one twisted pair 30 of the electric wires 31. Furthermore, the winding direction may be either Z-winding or S-winding. Also, with regard to the winding direction, the winding may be performed in the same direction as the pair twisting direction of the twisted pair 20 of the signal line 21 and the twisted pair 30 of the electric wires 31 or may be performed in a reverse direction. When the winding direction of the wrapping 51 is reverse to the pair winding direction of the twisted pair 20 of the signal line 21 and the twisted pair 30 of the electric wires 31, unevenness is less generated on the surface of the wrapping 51 and the outer shape of the multi-core cable 1 is easily stabilized, so that the case is preferred.

Since the wrapping 51 has a buffering action and has a function of enhancing bending resistance and a protecting function from the outside, layers of the filler 50 and the jacket 40 can be thinly configured in the case where the wrapping 51 is provided. By providing the wrapping 51 as such, a multi-core cable 1 that is more easily bent and excellent in abrasion resistance can be provided.

In the case where the resin-made jacket 40 is provided by extrusion coating, a space between the two electric wires 10 is filled with the resin, and therefore it becomes difficult to separate the two electric wires 10 at a terminal of the multi-core cable 1. By providing the wrapping 51, a space between the two power lines 10 is filled with the resin, and the two power lines 10 can be easily taken out at the terminal.

Furthermore, the multi-core cable 1 may contain an electric wire in addition to the two power lines 10, the two signal lines 21, and the two electric wires 31.

(Effect)

In the power line 10 according to the present embodiment, a soft inner layer 14 is provided between a hard outer layer 15 and the first conductor 12. When bending the first conductor 12, the soft inner layer 14 that is in contact with the first conductor 12 is deformed according to the bending of the first conductor 12 and absorbs the bending stress, so that a high stress is less generated on the first conductor 12. Therefore, a power line 10 having high bending resistance is provided while having abrasion resistance owing to the hard resin-made outer layer 15.

In the power line 10 according to the present embodiment, the inner layer 14 excellent in bending resistance is thicker than the outer layer 15, and the bending resistance is enhanced.

Furthermore, since the multi-core cable 1 of the present embodiment has the two power lines 10 and the jacket 40 that covers the two power lines 10, a wiring operation is easy as compared with the case where the two power lines are separately wired.

In addition, the multi-core cable 1 of the present embodiment has a plurality of second electric wires 21 each having a second conductor 22 thinner than the first conductor 12 and a second insulation layer 23 that covers the second conductor 22, and two wires of the second electric wire 21 are twisted as a set to constitute a twisted pair of the second electric wires 21, so that a wiring operation is easy as compared with the case where the two coated electric wires and the twisted pair of the second electric wires 21 are separately wired.

Moreover, in the multi-core cable 1 of the present embodiment, the two power lines 10 and the twisted pair of the second electric wires 21 are twisted and the twisted state is covered with the jacket 40, so that the outer shape of the multi-core cable 1 is stabilized along the longitudinal direction.

Furthermore, the two power lines 10 may be disposed in a point symmetry in a cross section of the multi-core cable 1.

In the multi-core cable 1 having the above configuration, thick power lines are disposed with good balance in a cross section and the cable has good symmetry, so that twisting tendency is less prone to be formed on the multi-core cable 1.

Second Embodiment

Figure 2:
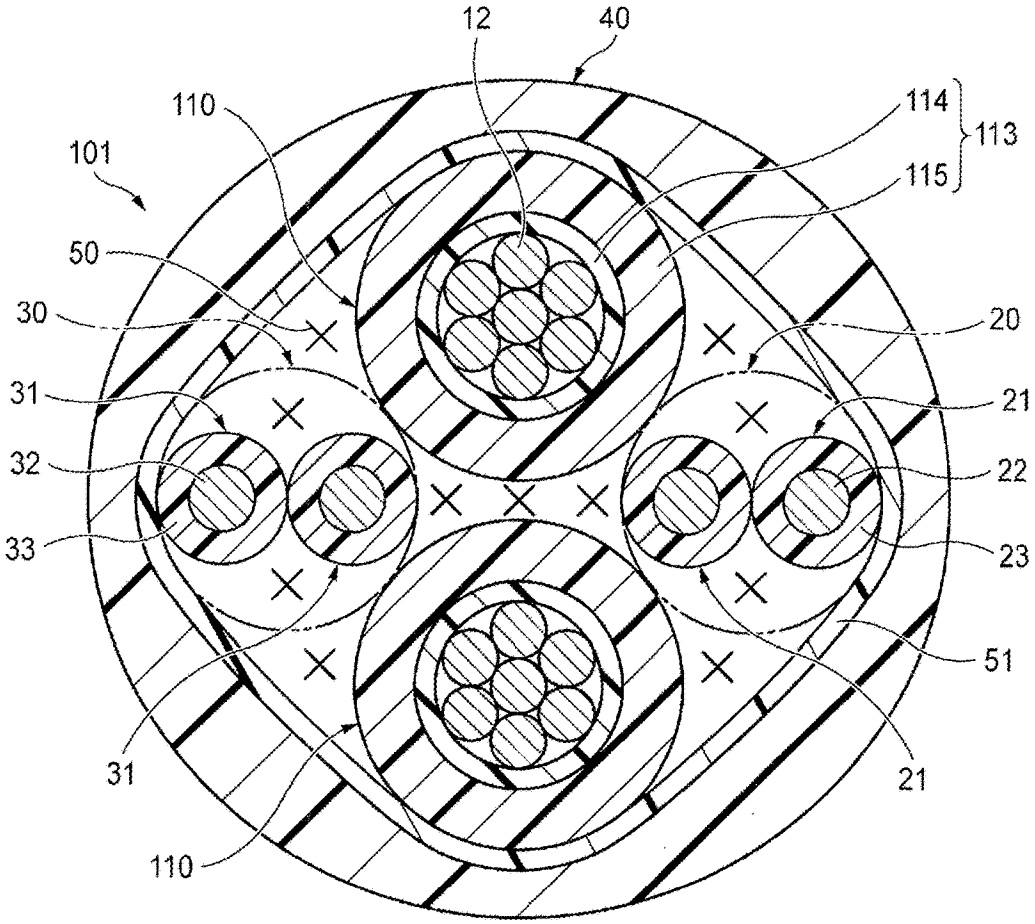
FIG. 2 is a cross-sectional view showing the coated electric wire and multi-core cable for vehicles according to the second embodiment of the present invention.

FIG. 2 is a cross-sectional view showing the multi-core cable 101 for vehicles according to the second embodiment of the present invention.

In the first embodiment mentioned above, there is described the multi-core cable 1 containing the two power lines 10 comprising the first insulation layer 13 that is formed of the inner layer 14 containing a copolymer of ethylene and an α-olefin having a carbonyl group and the outer layer 15 composed of a polyolefin or a fluororesin, but the present invention is not limited thereto.

For example, as shown in FIG. 2, a first insulation layer 113 may be formed of an inner layer 114 composed of a polyolefin or a fluororesin and an outer layer 115 containing a copolymer of ethylene and an α-olefin having a carbonyl group.

Moreover, in the present embodiment, the outer layer 115 is thicker than the inner layer 114 and the thickness of the inner layer is 0.05 mm or more.

Furthermore, the multi-core cable 101 may contain an electric wire in addition to two power lines 110, two signal lines 21, and two electric wires 31.

(Effect)

In the power line 110 according to the present embodiment, the inner layer 114 that comes into contact with the first conductor 12 is composed of a polyolefin or a fluororesin. The outer layer 115 provided outside the inner layer 114 is composed of a soft resin. Therefore, when bending the first conductor 12, the outer layer 115 is easily deformed so as to follow it and thus an excessive stress is less generated on the first conductor 12. For these reasons, the power line 110 according to the present embodiment has high bending resistance. Moreover, since the first conductor 12 is covered with a resin excellent in abrasion resistance, the first conductor 12 is hardly exposed to outside and the power line 110 of the present embodiment also has high abrasion resistance.

Further, in the case where the inner layer 114 that comes into contact with the first conductor 12 is composed of a fluororesin, since the first conductor 12 slips against the inner layer 114 when blending is made act on the first conductor 12, an excessive stress is less generated on the first conductor 12 that comes into contact with the inner layer 114.

In addition, in the power line 110 of the present embodiment, the outer layer 115 excellent in bending resistance is thicker than the inner layer 114, so that bending resistance is further enhanced.

Third Embodiment

In the embodiment mentioned above, there is described a multi-core cable 1 having an almost circular cross section in which the power lines 10, the twisted pair 20 of the signal line 21, and the twisted pair 30 of the electric wires 31 are integrally twisted, but the present invention is not limited thereto.

Figure 3:
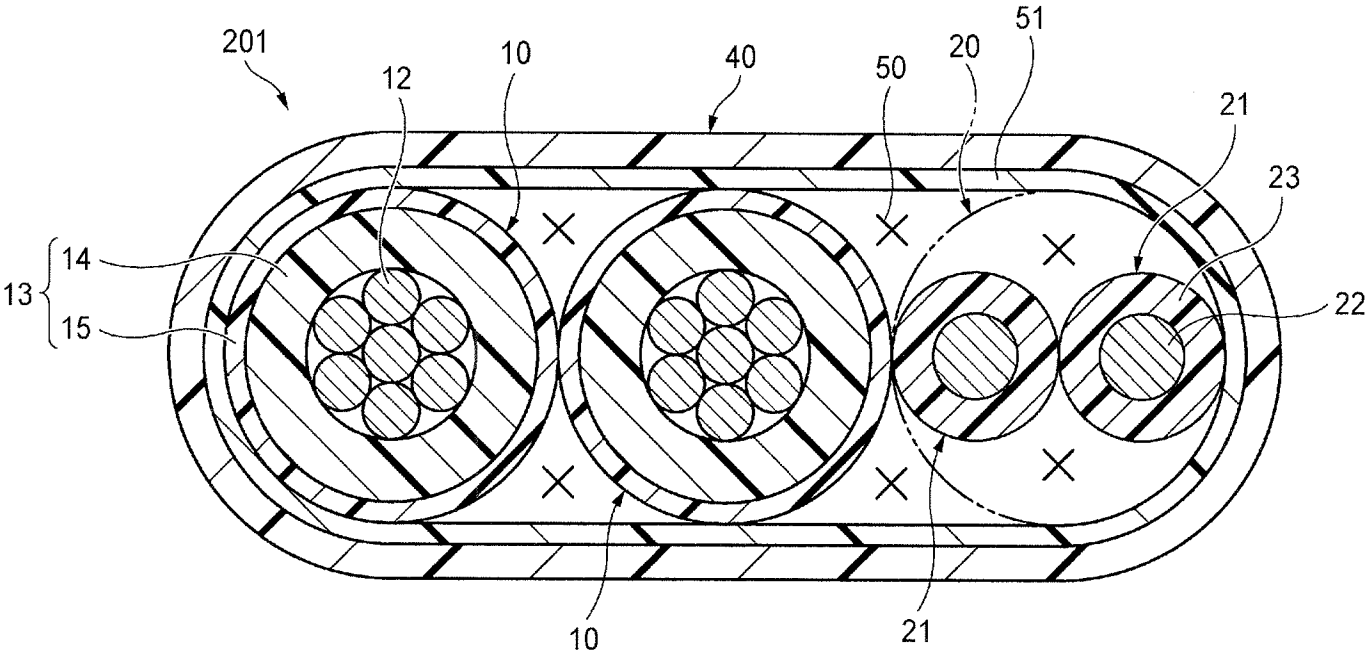
FIG. 3 is a cross-sectional view showing the coated electric wire and multi-core cable for vehicles according to the third embodiment of the present invention.

For example, as shown in FIG. 3, the cable may be a flattened multi-core cable 201 in which the power lines 10 and the twisted pair 20 of the signal line 21 are arranged in a line in a cross section. The multi-core flat cable 201 has a ratio of a major axis size to a minor axis size (major axis size/minor axis size) is 1.8 or more in a cross section.

The multi-core flat cable 201 of the above configuration can be suitably wired in a flat space. Moreover, it is easily bent in a minor axis direction (thickness direction) and is easily routed. Furthermore, the multi-core cable has a large contact area to a planar object to be attached such as a wall, and the multi-core cable is easily fixed to the object.

The multi-core cable 201 may contain an electric wire in addition to the two power lines 10 and the two signal lines 21.

EXAMPLE

The following will describe Examples of the present invention.

Example 1

A 6-core multi-core cable for vehicles configured as in the following Table 1 was produced.

A first conductor having a cross-sectional area of 2.5 $mm^2$ was obtained by stranding 7 bunch strands which had been obtained by twisting 72 wires of copper alloy wires each having a diameter of 0.08 mm. The first conductor was covered with a first insulation layer formed of an inner layer having a thickness of 0.2 mm and composed of EEA (a copolymer of ethylene and ethyl (meth)acrylate) and an outer layer having a thickness of 0.1 mm and composed of a crosslinked flame retardant polyethylene, thereby obtaining two power lines for EPB.

A second conductor having a cross-sectional area of 0.25 $mm^2$ was obtained by stranding 3 bunch strands which had been obtained by twisting 16 wires of copper alloy wires each having a diameter of 0.08 mm. The second conductor was covered with HDPE (high density polyethylene) as a second insulation layer so as to have an outer diameter of 1.4±0.1 mm, thereby obtaining two signal lines. The two signal lines were twisted as a set to obtain a twisted pair of the signal lines for ABS.

A third conductor having a cross-sectional area of 0.25 $mm^2$ was obtained by stranding 3 bunch strands which had been obtained by twisting 16 wires of copper alloy wires each having a diameter of 0.08 mm. The third, conductor was covered with HDPE as a third insulation layer so as to have an outer diameter of 1.4 mm, thereby obtaining two electric wires. The two electric wires were twisted as a set to obtain a twisted pair of the electric wires for onboard information system.

In Example 1, the twisted pair of the signal lines and the twisted pair of the electric wires are the same in size and material.

The two power lines, the twisted pair of the signal lines, and the twisted pair of the electric wires and the filler made of a crosslinked polyethylene were wound with a wrapping made of a thin paper, and the diameter of the assembled member was made 8.2 mm. The wrapping was covered with a jacket made of a crosslinked flame retardant polyurethane, and the outer diameter of the jacket was made 9.2±0.4 mm. Thus, a multi-core cable for vehicles according to Example 1 was produced.

Example 2

A 6-core multi-core cable for vehicles configured as in the following Table 2 was produced.

A first conductor having a cross-sectional area of 1.8 $mm^2$ was obtained by collectively twisting 7 wires, the wire having been obtained by twisting 52 wires of copper alloy wires each having a diameter of 0.08 mm. The first conductor was covered with a first insulation layer formed of an inner layer having a thickness of 0.3 mm and composed of a copolymer of ethylene and vinyl acetate (EVA) and an outer layer having a thickness of 0.1 mm and composed of a crosslinked flame retardant polyethylene, thereby obtaining two power lines for EPB.

A second conductor having a cross-sectional area of 0.25 $mm^2$ was obtained by collectively twisting 3 wires, the wire having been obtained by twisting 16 wires of copper alloy wires each having a diameter of 0.08 mm. The second conductor was covered with HDPE as a second insulation layer so as to have an outer diameter of 1.4±0.1 mm, thereby obtaining two signal lines. The two signal lines were twisted as a set to obtain a twisted pair of the signal lines for ABS.

A third conductor having a cross-sectional area of 0.25 $mm^2$ was obtained by collectively twisting 3 wires, the wire having been obtained by twisting 16 wires of copper alloy wires each having a diameter of 0.08 mm. The third conductor was covered with HDPE as a third insulation layer so as to have an outer diameter of 1.4 mm, thereby obtaining two electric wires. The two electric wires were twisted as a set to obtain a twisted pair of the electric wires for onboard information system.

In Example 2, the twisted pair of the signal lines and the twisted pair of the electric wires are the same in size and material.

The two power lines, the twisted pair of the signal lines, and the twisted pair of the electric wires were wound with a wrapping made of a thin paper together with a filler made of a crosslinked polyethylene, and the diameter was made 8.2 mm. The wrapping was covered with a jacket made of a crosslinked flame retardant polyurethane, and the outer diameter of the jacket was made 9.2±0.4 mm. Thus, a multi-core cable for vehicles according to Example 2 was produced.

Example 3

A 6-core multi-core cable for vehicles configured as in the following Table 3 was produced.

A first conductor having a cross-sectional area of 2.5 $mm^2$ was obtained by collectively twisting 7 wires, the wire having been obtained by twisting 72 wires of copper alloy wires each having a diameter of 0.08 mm. The first conductor was covered with a first insulation layer formed of an inner layer having a thickness of 0.1 mm and composed of a fluororesin and an outer layer having a thickness of 0.2 mm and composed of EEA, thereby obtaining two power lines for EPB.

A second conductor having a cross-sectional area of 0.25 $mm^2$ was obtained by collectively twisting 3 wires, the wire having been obtained by twisting 16 wires of copper alloy wires each having a diameter of 0.08 mm. The second conductor was covered with HDPE as a second insulation layer so as to have an outer diameter of 1.4±0.1 mm, thereby obtaining two signal lines. The two signal lines were twisted as a set to obtain a twisted pair of the signal lines for ABS.

A third conductor having a cross-sectional area of 0.25 $mm^2$ was obtained by collectively twisting 3 wires, the wire having been obtained by twisting 16 wires of copper alloy wires each having a diameter of 0.08 mm. The third conductor was covered with HDPE as a third insulation layer so as to have an outer diameter of 1.4 mm, thereby obtaining two electric wires. The two electric wires were twisted as a set to obtain a twisted pair of the electric wires for onboard information system.

In Example 3, the twisted pair of the signal lines and the twisted pair of the electric wires are the same in size and material.

The two power lines, the twisted pair of the signal lines, and the twisted pair of the electric wires were wound with a wrapping made of a thin paper together with a filler made of a crosslinked polyethylene, and the diameter was made 8.2 mm. The wrapping was covered with a jacket made of a crosslinked flame retardant polyurethane, and the outer diameter of the jacket was made 9.2±0.4 mm. Thus, a multi-core cable for vehicles according to Example 3 was produced.

Example 4

A 6-core multi-core cable for vehicles configured as in the following Table 4 was produced.

A first conductor having a cross-sectional area of 2.5 $mm^2$ was obtained by collectively twisting 7 wires, the wire having been obtained by twisting 72 wires of copper alloy wires each having a diameter of 0.08 mm. The first conductor was covered with a first insulation layer having a thickness of 0.1 mm and composed of a crosslinked flame retardant polyethylene.

A second conductor having a cross-sectional area of 0.25 $mm^2$ was obtained by collectively twisting 3 wires, the wire having been obtained by twisting 16 wires of copper alloy wires each having a diameter of 0.08 mm. The second conductor was covered with HDPE as a second insulation layer so as to have an outer diameter of 1.4±0.1 mm, thereby obtaining two signal lines. The two signal lines were twisted as a set to obtain a twisted pair of the signal lines for ABS.

A third conductor having a cross-sectional area of 0.25 $mm^2$ was obtained by collectively twisting 3 wires, the wire having been obtained by twisting 16 wires of copper alloy wires each having a diameter of 0.08 mm. The third conductor was covered with HDPE as a third insulation layer so as to have an outer diameter of 1.4 mm, thereby obtaining two electric wires. The two electric wires were twisted as a set to obtain a twisted pair of the electric wires for onboard information system.

In Example 4, the twisted pair of the signal lines and the twisted pair of the electric wires are the same in size and material.

The two power lines, the twisted pair of the signal lines, and the twisted pair of the electric wires were wound with a winding made of a thin paper together with a filler made of a crosslinked polyethylene, and the diameter was made 8.2 mm. The wrapping was covered with a jacket made of a crosslinked flame retardant polyurethane, and the outer diameter of the jacket was made 9.2±0.4 mm. Thus, a multi-core cable for vehicles according to Example 4 was produced.

(Repeated Bending Test)

The bending resistance of a multi-core cable was evaluated according to the repeated bending test defined in ISO 14572:2011(E)5.9. In the repeated bending test, bending the multi-core cable by the angle from −90° to +90° was repeatedly allowed to act on the multi-core cable. In the case where a decrease in the electric resistance value of the power line from the initial electric resistance value was 5% or more after 150,000 times of bending, it was judged that the power line was broken. The case where a decrease in the electric resistance value of the power line from the initial electric resistance value was less than 5% was regarded as passed.

In the multi-core cables according to the above Examples 1 to 3, the decrease in the electric resistance value after 150,000 times of bending was less than 5% and thus the cables were regarded as acceptable.

On the other hand, in the multi-core cable according to the above Example 4, the decrease in the electric resistance value after 150,000 times of bending was 5% or more and thus the cable was regarded as unacceptable.

(U-Shape Bending Test)

Evaluation was performed according to Automotive Standard JASO C467-97 7.16 Sensor Harness Bending Test specified by Public-interest Incorporated Foundation Society of Automotive Engineers of Japan, Inc. In the U-shape bending test, bending so as to be from a linear shape to a U-shape was allowed to act on a multi-core cable. After 300,000 times of bending at −30°, bending was subsequently performed 1,200,000 times at ordinary temperature. The case where appearance abnomiality such as cracking and crazing after the test was not observed and the decrease in the electric resistance value of the power line from the initial electric resistance value was less than 5% was regarded as acceptable.

The multi-core cables according to the above Examples 1 to 3 showed no appearance abnormality even after 300,000 times of bending at −30° and then 1,200,000 times of bending at ordinary temperature and the decrease in the electric resistance value of the power line was less than 5%, so that the cables were regarded as acceptable.

On the other hand, the multi-core cable according to the above Example 4, cracking was observed after 300,000 times of bending at −30° and then 1,200,000 times of bending at ordinary temperature and the decrease in the electric resistance value of the power line was 5% or more, so that the cable was regarded as unacceptable.

(Abrasion Resistance Test)

Abrasion resistance was evaluated according to Automotive Standard JASO D618:2013 Scrape Abrasion Test specified by Public-interest Incorporated Foundation Society of Automotive Engineers of Japan, Inc. In the abrasion test, an EPB wire as a specimen was fixed on a test stand, a needle was brought into contact with an insulation layer of the fixed specimen, and the needle was reciprocated in an axis direction of the specimen in a predetermined rate while a predetermined load was applied on the needle. The number of reciprocation until the insulation body was abraded and the needle came into contact with the conductor was counted. The case where the number of reciprocation was 750 times or more was regarded as acceptable, while the case where the number of reciprocation was less than 750 times was regarded as unacceptable.

In the multi-core cables according to the above Examples 1 to 3, when the number of reciprocation until the insulation body was abraded and the needle came into contact with the conductor was counted, the number of reciprocation was 750 times or more and thus the cables were acceptable.

On the other hand, in the multi-core cable according to the above Example 4, when the number of reciprocation until the insulation body was abraded and the needle came into contact with the conductor was counted, the number of reciprocation was less than 750 times and thus the cable was unacceptable.

TABLE 1

| | | | | |
|---|---|---|---|---|
| Power line | Conductor | Bunch-strand | Material of wire | tin-copper alloy |
| | | | Diameter of wire [mm] | 0.08 |
| | | | Number of wires | 72 |
| | | Rope-strand | Number of bunch-stranded members | 7 |
| | | | Cross-sectional area of conductor [mm$^2$] | 2.5 |
| | Insulation layer | Inner layer | Material | EEA |
| | | | Thickness [mm] | 0.2 |
| | | Outer layer | Material | crosslinked flame retardant polyethylene |
| | | | Thickness [mm] | 0.1 |
| Twisted pair of signal lines | Conductor | Bunch-strand | Material of wire | tin-copper alloy |
| | | | Diameter of wire [mm] | 0.08 |
| | | | Number of wires | 16 |
| | | Rope-strand | Number of bunch-stranded members | 3 |
| | | | Cross-sectional area of conductor [mm$^2$] | 0.25 |
| | Insulation layer | | Material | HDPE |
| | | | Outer diameter [mm] | 1.4 ± 0.1 |
| | Number of twisted lines | | | 2 |
| Twisted pair of electric wires | Conductor | Bunch-strand | Material of wire | tin-copper alloy |
| | | | Diameter of wire [mm] | 0.08 |
| | | | Number of bunch-strands | 16 |
| | | Rope-strand | Number of bunch-stranded members | 3 |
| | | | Cross-sectional area of conductor [mm$^2$] | 0.25 |
| | Insulation layer | | Material | HDPE |
| | | | Outer diameter [mm] | 1.4 ± 0.1 |
| | Number of twisted wires | | | 2 |
| Assembly | Number of cores | | | 6 |
| Filler | Material | | | crosslinked polyethylene |
| Wrapping | Material | | | thin paper |
| | Outer diameter [mm] | | | 8.2 |
| Jacket | Material | | | crosslinked flame retardant polyurethane |
| | Outer diameter [mm] | | | 9.2 ± 0.4 |
| | Repeated bending test ISO 14572: 2011(E)5.9 | | | acceptable |
| | U-shape bending test JASO C467-97 7.16 | | | acceptable |
| | Abrasion resistance test JASO D618: 2013 | | | acceptable |

TABLE 2

| | | | | |
|---|---|---|---|---|
| Power line | Conductor | Bunch-strand | Material of wire | tin-copper alloy |
| | | | Diameter of wire [mm] | 0.08 |
| | | | Number of wires | 52 |
| | | Rope-strand | Number of bunch-stranded members | 7 |
| | | | Cross-sectional area of conductor [mm$^2$] | 1.8 |
| | Insulation layer | Inner layer | Material | EVA |
| | | | Thickness [mm] | 0.3 |
| | | Outer layer | Material | crosslinked flame retardant polyethylene |
| | | | Thickness [mm] | 0.1 |
| Twisted pair of signal lines | Conductor | Bunch-strand | Material of wire | tin-copper alloy |
| | | | Diameter of wire [mm] | 0.08 |
| | | | Number of wires | 16 |
| | | Rope-strand | Number of bunch-stranded members | 3 |
| | | | Cross-sectional area of conductor [mm$^2$] | 0.25 |
| | Insulation layer | | Material | HDPE |
| | | | Outer diameter [mm] | 1.4 ± 0.1 |
| | Number of twisted lines | | | 2 |

TABLE 2-continued

| | | | | |
|---|---|---|---|---|
| Twisted pair of electric wires | Conductor | Bunch-strand | Material of wire | tin-copper alloy |
| | | | Diameter of wire [mm] | 0.08 |
| | | | Number of wires | 16 |
| | | Rope-strand | Number of bunch-stranded members | 3 |
| | | | Cross-sectional area of conductor [$mm^2$] | 0.25 |
| | Insulation layer | | Material | HDPE |
| | | | Outer diameter [mm] | 1.4 ± 0.1 |
| | Number of twisted Wires | | | 2 |
| Assembly | Number of cores | | | |
| Filler | Material | | | crosslinked polyethylene |
| Wrapping | Material | | | thin paper |
| | Outer diameter [mm] | | | 8.2 |
| Jacket | Material | | | crosslinked flame retardant polyurethane |
| | Outer diameter [mm] | | | 9.2 ± 0.4 |
| | Repeated bending test ISO 14572: 2011(E)5.9 | | | acceptable |
| | U-shape bending test JASO C467-97 7.16 | | | acceptable |
| | Abrasion resistance test JASO D618: 2013 | | | acceptable |

TABLE 3

| | | | | |
|---|---|---|---|---|
| Power line | Conductor | Bunch-strand | Material of wire | tin-copper alloy |
| | | | Diameter of wire [mm] | 0.08 |
| | | | Number of wires | 72 |
| | | Rope-strand | Number of bunch-stranded members | 7 |
| | | | Cross-sectional area of conductor [$mm^2$] | 2.5 |
| | | | Outer diameter [mm] | 2.4 |
| | Insulation layer | Inner layer | Material | fluororesin |
| | | | Thickness [min] | 0.1 |
| | | Outer layer | Material | EEA |
| | | | Thickness [mm] | 0.2 |
| Twisted pair of signal lines | Conductor | Bunch-strand | Material of wire | tin-copper alloy |
| | | | Diameter of wire [mm] | 0.08 |
| | | | Number of wires | 16 |
| | | Rope-strand | Number of bunch-stranded members | 3 |
| | | | Cross-sectional area of conductor [$mm^2$] | 0.25 |
| | Insulation layer | | Material | HDPE |
| | | | Outer diameter [mm] | 1.4 ± 0.1 |
| | Number of twisted lines | | | 2 |
| Twisted pair of electric wires | Conductor | Bunch-strand | Material of wire | tin-copper alloy |
| | | | Diameter of wire [mm] | 0.08 |
| | | | Number of bunch-strands | 16 |
| | | Rope-strand | Number of bunch-stranded members | 3 |
| | | | Cross-sectional area of conductor [$mm^2$] | 0.25 |
| | Insulation layer | | Material | HDPE |
| | | | Outer diameter [mm] | 1.4 ± 0.1 |
| | Number of twisted Wires | | | 2 |
| Assembly | Number of cores | | | 6 |
| Filler | Material | | | crosslinked polyethylene |
| Wrapping | Material | | | thin paper |
| | Outer diameter [mm] | | | 8.2 |
| Jacket | Material | | | crosslinked flame retardant polyurethane |
| | Outer diameter [mm] | | | 9.2 ± 0.4 |
| | Repeated bending test ISO 14572: 2011(E)5.9 | | | acceptable |
| | U-shape bending test JASO C467-97 7.16 | | | acceptable |
| | Abrasion resistance test JASO D618: 2013 | | | acceptable |

TABLE 4

| | | | | |
|---|---|---|---|---|
| Power line | Conductor | Bunch-strand | Material of wire | tin-copper alloy |
| | | | Diameter of wire [mm] | 0.08 |
| | | | Number of wires | 72 |
| | | Rope-strand | Number of bunch-stranded members | 7 |
| | | | Cross-sectional area of conductor [$mm^2$] | 2.5 |
| | | | Outer diameter [mm] | 2.4 |
| | Insulation layer | | Material | crosslinked flame retardant polyethylene |
| | | | Thickness [mm] | 0.1 |
| Twisted pair of signal lines | Conductor | Bunch-strand | Material of wire | tin-copper alloy |
| | | | Diameter of wire [mm] | 0.08 |
| | | | Number of wires | 16 |
| | | Rope-strand | Number of bunch-stranded members | 3 |
| | | | Cross-sectional area of conductor [$mm^2$] | 0.25 |
| | Insulation layer | | Material | HDPE |
| | | | Outer diameter [mm] | 1.4 ± 0.1 |
| | Number of twisted lines | | | 2 |

TABLE 4-continued

| | | | | |
|---|---|---|---|---|
| Twisted pair of electric wires | Conductor | Bunch-strand | Material of wire | tin-copper alloy |
| | | | Diameter of wire [mm] | 0.08 |
| | | | Number of bunch-strands | 16 |
| | | Rope-strand | Number of bunch-stranded members | 3 |
| | | | Cross-sectional area of conductor [$mm^2$] | 0.25 |
| | Insulation layer | | Material | HDPE |
| | | | Outer diameter [mm] | 1.4 ± 0.1 |
| | Number of twisted Wires | | | 2 |
| Assembly | Number of cores | | | 6 |
| Filler | Material | | | crosslinked polyethylene |
| Wrapping | Material | | | thin paper |
| | Outer diameter [mm] | | | 8.2 |
| Jacket | Material | | | crosslinked flame retardant polyurethane |
| | Outer diameter [mm] | | | 9.2 ± 0.4 |
| | Repeated bending test ISO 14572: 2011(E)5.9 | | | unacceptable |
| | U-shape bending test JASO C467-97 7.16 | | | unacceptable |
| | Abrasion resistance test JASO D618: 2013 | | | unacceptable |

What is claimed is:

1. A coated electric wire comprising a conductor and a resin-made insulation layer that covers the conductor:

cross-sectional area of the conductor being 1.5 $mm^2$ or more and 3.0 $mm^2$ or less, the insulation layer covering the conductor in a thickness of 0.3 mm or more and 0.5 mm or less, and the insulation layer having an inner layer and an outer layer that is provided on the outer periphery of the inner layer, wherein the inner layer contains a copolymer of ethylene and an α-olefin having a carbonyl group as a main component, and the outer layer is composed of a polyolefin or a fluororesin, and wherein the inner layer is thicker than the outer layer, and the thickness of the outer layer is 0.05 mm or more.

2. The coated electric wire according to claim 1, wherein the α-olefin having a carbonyl group contains at least one of (meth)acrylic acid alkyl esters, (meth)acrylic acid aryl esters, vinyl esters, unsaturated acids, vinyl ketones, and (meth)acrylic acid amides.

3. A multi-core cable comprising two wires of the coated electric wire according to claim 1 and a jacket that covers the two coated electric wires.

4. The multi-core cable according to claim 3, which has a plurality of second electric wires each having a second conductor thinner than the conductor and a second insulation layer that covers the second conductor and wherein the two second electric wires are twisted as a set to constitute a twisted pair of the second electric wires.

5. The multi-core cable according to claim 4, wherein the two coated electric wire and the twisted pair of the second electric wires are stranded and the jacket covers the stranded two coated electric wires and the twisted pair of the second electric wires.

6. The multi-core cable according to claim 5, wherein the two coated electric wires are disposed in a point symmetry in a cross section.

7. The multi-core cable according to claim 3, wherein the ratio of a major axis length to a minor axis length (major axis length/minor axis length) is 1.8 or more in a cross section.

* * * * *